US008643263B2

(12) United States Patent
Burrows

(10) Patent No.: US 8,643,263 B2
(45) Date of Patent: Feb. 4, 2014

(54) INSULATOR STRENGTH BY SEAT GEOMETRY

(71) Applicant: John Antony Burrows, Northwich (GB)

(72) Inventor: John Antony Burrows, Northwich (GB)

(73) Assignee: Federal-Mogul Corporation, Southfield, MI (US)

( * ) Notice: Subject to any disclaimer, the term of this patent is extended or adjusted under 35 U.S.C. 154(b) by 0 days.

(21) Appl. No.: 13/709,237

(22) Filed: Dec. 10, 2012

(65) Prior Publication Data

US 2013/0147339 A1 Jun. 13, 2013

Related U.S. Application Data

(60) Provisional application No. 61/568,889, filed on Dec. 9, 2011.

(51) Int. Cl.
*H01T 13/20* (2006.01)
*H01T 13/00* (2006.01)

(52) U.S. Cl.
USPC ..... 313/143; 313/118; 313/144; 313/142

(58) Field of Classification Search
None
See application file for complete search history.

(56) References Cited

U.S. PATENT DOCUMENTS

| | | | | |
|---|---|---|---|---|
| 1,852,265 | A | 4/1932 | Rohde | |
| 2,250,355 | A | 7/1941 | Bruck | |
| 3,668,749 | A | 6/1972 | Podiak et al. | |
| 4,015,160 | A | 3/1977 | Lara et al. | |
| 4,015,161 | A | 3/1977 | Resler, Jr. | |
| 4,169,388 | A | 10/1979 | Teitelbaum et al. | |
| 5,831,377 | A | 11/1998 | Matsubara et al. | |
| 6,680,561 | B2 * | 1/2004 | Yamaguchi et al. | 313/118 |
| 7,215,069 | B2 * | 5/2007 | Suzuki | 313/143 |
| 7,808,165 | B2 * | 10/2010 | Kowalski | 313/141 |
| 7,816,846 | B2 * | 10/2010 | Takada et al. | 313/143 |
| 8,294,347 | B2 * | 10/2012 | Nakamura et al. | 313/144 |
| 2005/0104497 | A1 | 5/2005 | Fischer et al. | |
| 2007/0290593 | A1 * | 12/2007 | Kowalski | 313/141 |
| 2008/0093965 | A1 | 4/2008 | Takada et al. | |

FOREIGN PATENT DOCUMENTS

| | | | |
|---|---|---|---|
| EP | 1309052 | A2 | 5/2003 |
| JP | 6139880 | U | 3/1986 |
| WO | WO-2010035717 | A1 | 4/2010 |

OTHER PUBLICATIONS

International Search Report PCT/US2012/068673 mailed on Feb. 12, 2013.

* cited by examiner

*Primary Examiner* — Natalie Walford
(74) *Attorney, Agent, or Firm* — Robert L. Stearns; Dickinson Wright, PLLC

(57) ABSTRACT

A spark plug (20) includes an insulator seat angle ($\alpha_i$) of 35° to 50° and an increased insulator thickness ($t_i$) in selected areas around the insulator seat (28). The insulator seat angle ($\alpha_i$) is greater than or equal to a boundary value provided by the equation: $90°-a\cos[1-(R_1-R_2)\div(R_4+R_5)]$, and preferably not greater than 150% of the boundary value. The radii ($R_1$, $R_2$, $R_3$, $R_4$, $R_5$) can be adjusted to maximize $R_4$ while maintaining an acceptable $R_2$. A gasket is compressed between the insulator (22) and shell (58), and the inner gasket thickness ($t_{g2}$) is greater than or equal to 70% of the outer gasket thickness ($t_{g1}$).

21 Claims, 5 Drawing Sheets

INSULATOR STRENGTH BY SEAT GEOMETRY

CROSS REFERENCE TO RELATED APPLICATION

This application claims the benefit of application Ser. No. 61/568,889 filed Dec. 9, 2011, the entire contents of which is hereby incorporated by reference.

BACKGROUND OF THE INVENTION

1. Field of the Invention

This invention relates generally to spark plugs, and more particularly to insulator geometry of the spark plugs, and methods of manufacturing the same.

2. Related Art

Spark plugs for use in combustion chambers of automotive or industrial engines include a center electrode and a ground electrode providing a spark gap therebetween. During operation, a spark forms across the spark gap to ignite a combustible mixture of fuel and air. An insulator surrounds and electrically isolates the central electrode, and also provides mechanical support to the central electrode. The insulator is surrounded by a metal shell which is threaded into a cylinder head of the engine. According to one spark plug design, the insulator includes a body region and a tapering nose region which are separated by an insulator seat. A gasket is compressed between insulator seat and shell to maintain the insulator in position. The preload on the gasket should be high enough to seal under all operating conditions. However, the high preload causes tensile stress around the gasket and along the insulator seat.

The insulator of the spark plug also experiences significant bending stress around the insulator seat when used in a high-output engine. These engines generate "mega-knock" or "super-knock" causing high pressure transient shock waves which create a force transverse to the insulator nose region.

SUMMARY OF THE INVENTION

One aspect of the invention provides a spark plug including an insulator geometry providing reduced tensile stress during installation and increased bending strength during use in a high-output engine. The insulator extends along a center axis and presents an insulator outer surface extending from an insulator upper end to an insulator nose end. An insulator body region extends between the insulator upper end and the insulator nose end. The insulator presents a first radius ($R_1$) at the insulator body region extending from the center axis to the insulator outer surface. The insulator also includes an insulator nose region between the insulator body region and the insulator nose end. The insulator presents a sixth radius ($R_6$) at the insulator nose region extending from the center axis to the insulator outer surface. The sixth radius is less than the first radius.

An insulator seat is disposed between the insulator body region and the insulator nose region. The insulator seat extends radially toward the center at an insulator seat angle. The insulator includes a convex first transition extending from the insulator body region to the insulator seat. The insulator presents a fifth radius ($R_5$) at the first transition, and the fifth radius is a spherical radius. The insulator also presents a concave second transition extending from the insulator seat to the insulator nose region. The insulator presents a second radius ($R_2$) extending from the center axis to a point at the intersection of the insulator outer surface of the insulator seat and the insulator outer surface of the insulator nose region adjacent the second transition. The insulator presents a fourth radius ($R_4$) at the second transition, and the fourth radius is a spherical radius. The insulator seat angle is from 35° to 50°, and the insulator seat angle is greater than or equal to a boundary value provided by the equation: $90°-a\cos[1-(R_1-R_2)\div(R_4+R_5)]$.

Another aspect of the invention provides a method of forming the spark plug. The method includes selecting a value for the insulator seat angle between 35° to 50°; obtaining values for $R_1$, $R_2$, $R_4$, and $R_5$; and determining whether the selected insulator seat angle ($\alpha_i$) is greater than or equal to a boundary value provided by the equation: $90°-a\cos[1-(R_1-R_2)\div(R_4+R_5)]$.

The geometry of the insulator seat provides reduced tensile stress along and around the insulator seat during assembly of the spark plug, particularly reduced tensile stress caused by compressing the gasket between the insulator and shell. The geometry of the insulator seat also provides increased bending strength along and around the insulator seat when the spark plug is used in a high-output engine.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
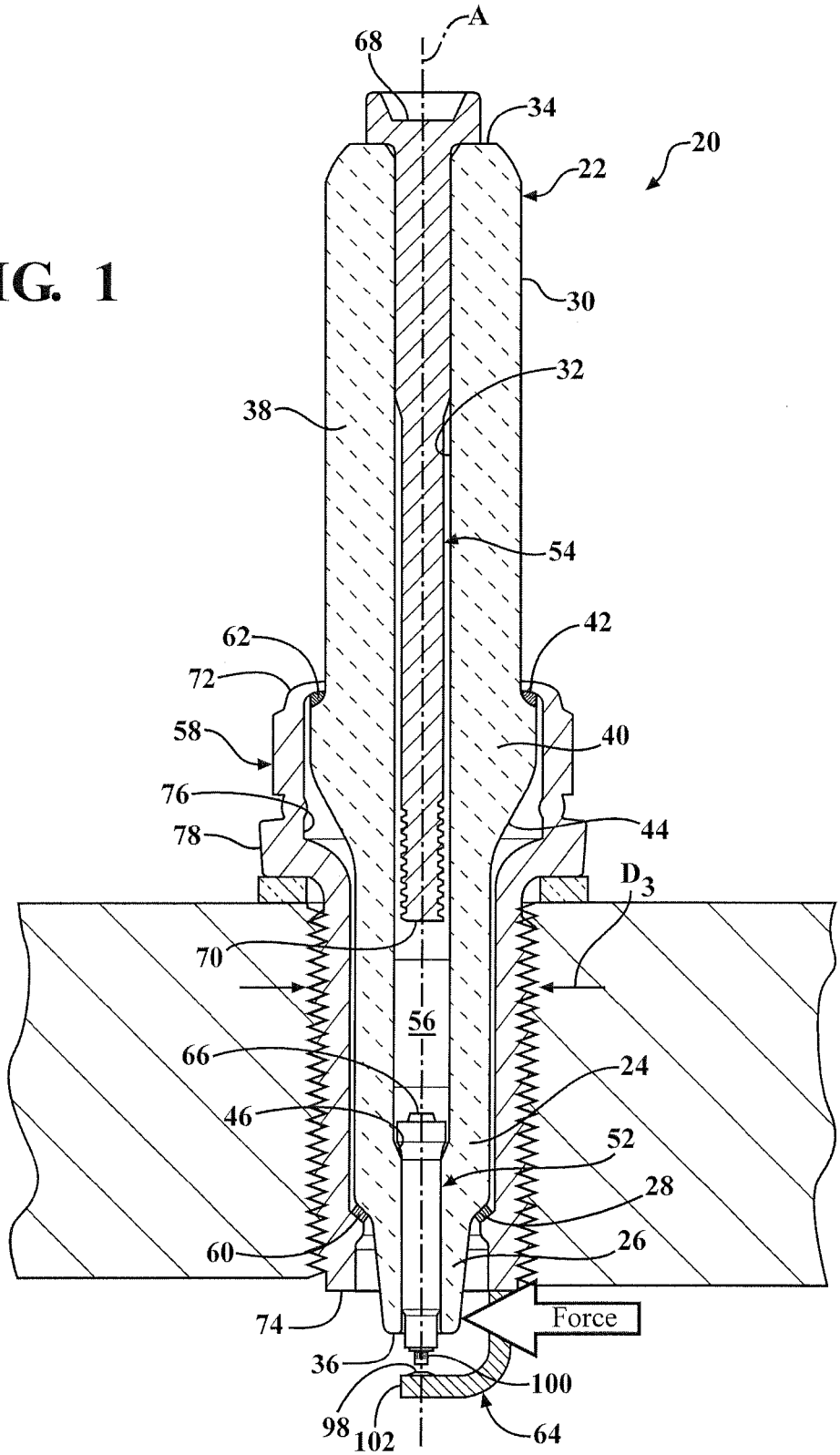
FIG. 1 is a cross-sectional view of a spark plug in accordance with one embodiment of the invention.

One aspect of the invention provides a spark plug 20 for use in an internal combustion engine, as shown in FIG. 1. The spark plug 20 includes an insulator 22 with reduced tensile stress during assembly and increased bending strength when subjected to shock wave forces that occur due to mega-knock or super-knock in a high-output engine. The insulator 22 includes an insulator body region 24 and an insulator nose region 26 with an insulator seat 28 therebetween. The insulator 22 is designed to include an insulator seat angle $\alpha_i$ of 35° to 50° and an increased insulator thickness $t_i$ in selected areas around the insulator seat 28.

Figure 3:
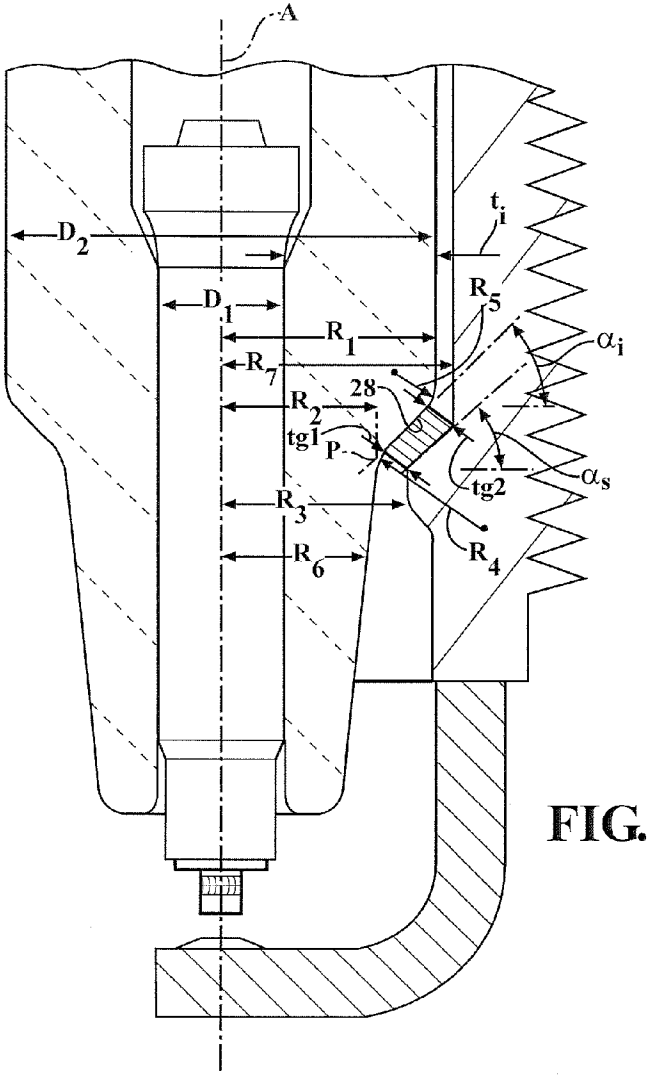
FIG. 3 is an enlarged view of a portion of a spark plug according to a second embodiment of the invention.
Figure 2:
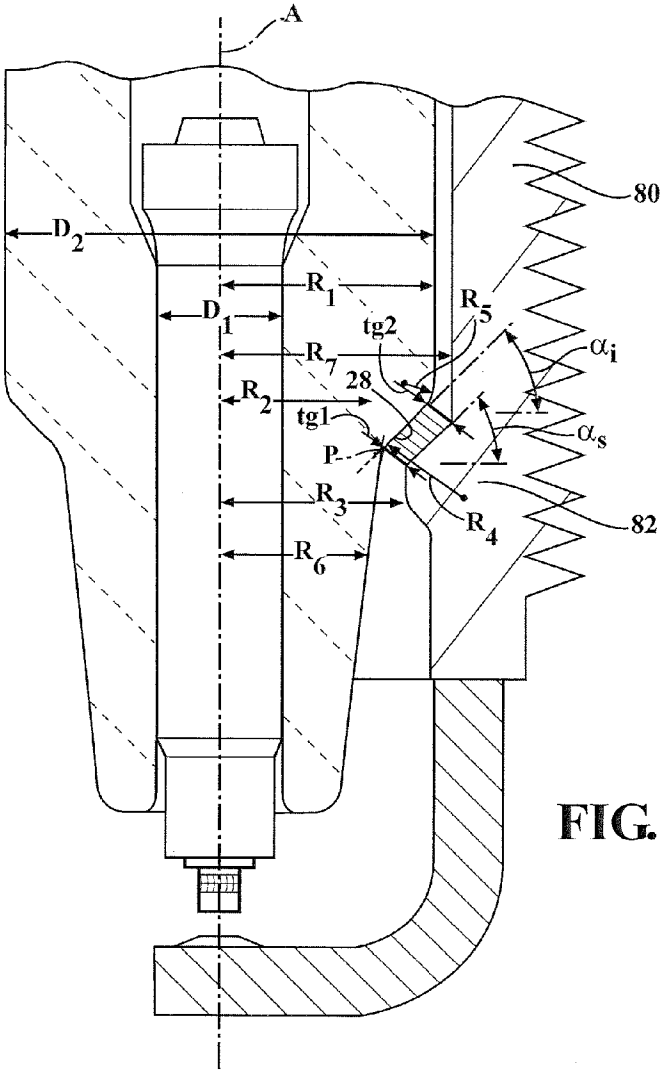
FIG. 2 is an enlarged view of a portion of FIG. 1 around the insulator seat.

As shown in FIG. 1, the insulator 22 of the spark plug 20 extends along a center axis A and presents an insulator outer surface 30 and an oppositely facing insulator inner surface 32 each extending longitudinally from an insulator upper end 34 to an insulator nose end 36. The insulator inner surface 32 and the insulator outer surface 30 present an insulator thickness $t_i$ therebetween, as shown in FIGS. 2 and 3. The insulator inner surface 32 extends annularly around the center axis A and presents a bore. The insulator inner surface 32 presents an insulator inner diameter $D_1$ surrounding the bore and the insulator outer surface 30 presents an insulator outer diameter $D_2$, as shown in FIGS. 2 and 3.

In the embodiment of FIG. 1, the insulator 22 includes an insulator terminal region 38, an insulator transition region 40, the insulator body region 24, and the insulator nose region 26. The insulator terminal region 38 extends from the insulator upper end 34 toward the insulator nose end 36. The insulator transition region 40 is disposed between the insulator terminal region 38 and the insulator body region 24. The insulator thickness $t_i$ varies along the insulator transition region 40. Along one portion of the insulator transition region 40, the insulator thickness $t_i$ is greater than the insulator thickness $t_i$ along the insulator terminal region 38. Along another portion of the insulator transition region 40, the insulator thickness $t_i$ is less than the insulator thickness $t_i$ along the insulator terminal region 38 and decreases toward the insulator body region 24. An insulator upper shoulder 42 extends from the insulator terminal region 38 to the insulator transition region 40, and the insulator thickness $t_i$ along the insulator upper shoulder 42 increases from the insulator terminal region 38 to the insulator transition region 40.

The insulator body region 24 is disposed between the insulator transition region 40 and the insulator nose region 26. The insulator 22 presents a first radius $R_1$ along the insulator body region 24 extending from the center axis A to the insulator outer surface 30, as shown in FIGS. 2 and 3. The insulator thickness $t_i$ along the insulator body region 24 is less than the insulator thickness $t_i$ along the insulator terminal region 38 and less than the insulator thickness $t_i$ along the insulator transition region 40. The ratio of the insulator inner diameter $D_1$ to the insulator outer diameter $D_1$ along the insulator body region (24) adjacent the insulator seat 28 is preferably from 0.12 to 0.45, and more preferably from 0.18 to 0.38. An insulator lower shoulder 44 extends from the insulator transition region 40 to the insulator body region 24, and the insulator thickness $t_i$ along the insulator lower shoulder 44 decreases from the insulator transition region 40 to the insulator body region 24.

The insulator inner surface 32 along the insulator body region 24 presents an electrode seat 46, and the insulator thickness $t_i$ along a portion of the insulator body region 24 increases toward the center axis A and toward the insulator nose end 36 to present the electrode seat 46. In the embodiment of FIG. 1, the insulator thickness $t_i$ along the insulator body region 24 is generally constant but increases slightly at the electrode seat 46.

The insulator nose region 26 is disposed between the insulator body region 24 and the insulator nose end 36. The insulator 22 presents a sixth radius $R_6$ along the insulator nose region 26 extending from the center axis A to the insulator outer surface 30, as shown in FIGS. 2 and 3. The sixth radius $R_6$ presented by the insulator nose region 26 is less than the first radius $R_1$ presented by the insulator body region 24. In the embodiment of FIG. 1, the sixth radius $R_6$ of the insulator nose region 26 tapers toward the insulator nose end 36. The insulator thickness $t_i$ along the insulator nose region 26 is less than the insulator thickness $t_i$ along the insulator body region 24, and the insulator thickness $t_i$ decreases toward the insulator nose end 36.

As shown in FIGS. 1-3, the insulator seat 28 is disposed between the insulator body region 24 and the insulator nose region 26. The insulator seat 28 extends at an insulator seat angle $\alpha_i$ radially inwardly toward the center axis A and downwardly toward the insulator nose end 36. The insulator seat angle $\alpha_i$ is measured relative to a plane extending perpendicular to the center axis A and intersecting the insulator seat 28, as shown in FIGS. 2 and 3. The insulator thickness $t_i$ along the insulator seat 28 decreases from the insulator body region 24 to the insulator nose region 26.

The insulator 22 also includes a first transition 48 extending continuously from the insulator body region 24 to the insulator seat 28, and the first transition 48 is convex. The first radius $R_1$ presented by the insulator body region 24 is typically constant from the insulator lower shoulder 44 to the first transition 48. The insulator 22 also presents a fifth radius $R_5$ at the first transition 48, which is a spherical radius at point located along the first transition 48, as shown in FIGS. 2 and 3. The spherical radius at a particular point is obtained from a sphere having a radius at that particular point. The spherical radius is the radius of the sphere in three dimensions.

A second transition 50 extends continuously from the insulator seat 28 to the insulator nose region 26, and the second transition 50 is concave. The insulator 22 presents a second radius $R_2$ extending from the center axis A to a point P at the intersection of the insulator outer surface 30 of the insulator seat 28 and the insulator outer surface 30 of the insulator nose region 26 adjacent the second transition 50, as shown in FIGS. 2 and 3. A fourth radius $R_4$ is also located at the second transition 50, and the fourth radius $R_4$ is a spherical radius at a point located along the second transition 50.

The insulator 22 includes an increased insulator seat angle $\alpha_i$, compared to spark plug insulators of the prior art. The insulator seat angle $\alpha_i$ of the inventive spark plug is from 35° to 50°, whereas seat angles of the prior art are 30° or less. In one preferred embodiment, the insulator seat angle $\alpha_i$ is 45°, or within +/−2° of 45°.

The insulator 22 also includes an increased insulator thickness $t_i$ around the insulator seat 28. The value of the fourth radius $R_4$ is maximized, while maintaining an acceptable value for the second radius $R_2$. The increased insulator seat angle $\alpha_i$ and fourth radius $R_4$ provides reduced tensile stress during assembly and increased bending strength when subjected to shock wave forces due to mega-knock or super-knock which occur during use of the spark plug 20 in a combustion engine.

The insulator seat angle $\alpha_i$ is also greater than or equal to a boundary value provided by the equation: $90° - a\cos[1-(R_1-R_2)\div(R_4+R_5)]$. When manufacturing the insulator 22, the method typically includes selecting a desired insulator seat angle $\alpha_i$ from 35° to 50°, and then using the equation to determine values for $R_1$, $R_2$, $R_3$, $R_4$, and $R_5$ that provide a boundary value less than or equal to the desired seat angle. The method typically includes adjusting at least one of the values of $R_1$, $R_2$, $R_3$, $R_4$, and $R_5$ to obtain the desired insulator geometry. For example, the value of $R_4$ is typically increased to a maximum value that provides the desired seat angle while maintaining an acceptable value of $R_2$. The insulator seat angle $\alpha_i$ is preferably not greater than 300%, more preferably not greater than 200%, and yet more preferably not more than 150% of the boundary value obtained by the equation.

The insulator 22 is formed of an electrically insulator 22 material, and preferably a material having a dielectric strength of 14 to 30 kV/mm, a coefficient of thermal expansion (CTE) between $2\times10^{-6}$PC and $18\times10^{-6}$/° C., and a relative permittivity of 2 to 12. In one embodiment, the electrically insulating material includes alumina. A coating (not shown) can optionally be applied to the insulator outer surface 30. The coating typically includes nickel or copper.

The spark plug 20 of FIG. 1 also includes a center electrode 52, a terminal 54, a seal 56, a shell 58, a pair of gaskets 60, 62, and a ground electrode 64. The center electrode 52 is received in the bore of the insulator 22 and extends longitudinally along the center axis A from an electrode terminal end 66 past the insulator nose end 36 to a center electrode firing end 100. The center electrode 52 includes a head at the electrode terminal end 66 resting on the electrode seat 46 of the insulator 22. A terminal 54 is received in the bore of the insulator 22 and extends longitudinally along the center axis A from an energy input end 68 to an energy output end 70 spaced from electrode terminal end 66. A seal 56 is also contained in the bore of the insulator 22 and extends continuously between the energy output end 70 of the terminal 54 and the electrode terminal end 66. The seal 56 can be resistive or non-resistive.

The shell 58 is formed of a metal material, preferably steel, and is disposed annularly around the insulator 22. The shell 58 extends longitudinally from a shell upper end 72 along the insulator transition region 40 and the insulator body region 24 to a shell lower end 74. The shell 58 presents a shell inner surface 76 facing the insulator outer surface 30 and a shell outer surface 78 facing opposite the shell inner surface 76. The shell inner surface 76 and the shell outer surface 78 each extend from the shell upper end 72 to the shell lower end 74, and the shell inner surface 76 and the shell outer surface 78 present a shell thickness $t_s$ therebetween. As shown in FIG. 1, the shell 58 has a shell outer diameter $D_3$, which is typically 12 mm, but can alternatively be from 8 mm to 18 mm.

The shell 58 includes a shell body region 80 extending along the center axis A between the shell upper end 72 and the shell lower end 74. The shell 58 presents a seventh radius $R_7$ along the shell body region 80, as shown in FIGS. 2 and 3. The seventh radius $R_7$ extends from the center axis A to the shell inner surface 76. The top of the shell 58 is bent such that the shell upper end 72 rests on the insulator upper shoulder 42. The shell lower end 74 is disposed along the insulator nose region 26 such that the insulator nose end 36 is disposed outwardly of the shell lower end 74.

The shell 58 includes a rib 82 adjacent the insulator seat 28, as shown in FIGS. 1-3. The rib 82 extends radially toward the center axis A and is disposed between the shell body region 80 and the shell lower end 74. The shell thickness $t_s$ is constant along the insulator body region 24 and increases adjacent the insulator seat 28 to present the rib 82. The rib 82 includes a shell seat 84 preferably facing parallel to the insulator seat 28 and extending radially inwardly toward the center axis A and downwardly toward the shell lower end 74. The shell seat 84 extends at a shell seat angle $\alpha_s$ which is relative to a plane extending perpendicular to the center axis A and intersecting the shell seat 84, as shown in FIGS. 2 and 3. The shell seat angle $\alpha_s$ is preferably equal to the insulator seat angle $\alpha_i$ or within +/−1° of the insulator seat angle $\alpha_i$.

The shell seat 84 extends from the shell body region 80 to a rib inner surface 86. The shell thickness $t_s$ increases gradually along the shell seat 84 to the rib inner surface 86 and is constant along the rib inner surface 86. In the embodiment of FIG. 1, the rib inner surface 86 is disposed at the innermost point of the shell inner surface 76. The shell 58 presents a third radius $R_3$ at the rib inner surface 86 extending from the center axis A to the shell inner surface 76, as shown in FIGS. 2 and 3. The third radius $R_3$ is less than the seventh radius $R_7$ of the shell body region 80. The rib 82 also includes a rib lower surface 88 facing toward the shell lower end 74. The rib lower surface 88 extends radially outwardly from the rib inner surface 86 at an angle. The shell thickness $t_s$ decreases along the rib lower surface 88 toward the shell lower end 74. The shell outer surface 78 includes threads along at least a portion of the shell body region 80 and adjacent the rib 82, so that the shell 58 can be threaded into a cylinder head.

The spark plug 20 of FIG. 1 includes a first gasket 60 compressed between the insulator seat 28 and the shell seat 84, and can include a second gasket 62 compressed between the insulator upper shoulder 42 and the shell upper end 72. The gaskets 60, 62 are formed of a metal material, such as steel or copper.

The first gasket 60 has a gasket inner surface 90 facing generally toward the insulator 22 and a gasket outer surface 92 facing generally toward the shell 58. The gasket inner surface 90 and the gasket outer surface 92 both extend from a gasket top surface 94 to a gasket bottom surface 96. A lubricant (not shown) may be applied to the gasket during assembly of the spark plug 20. The gasket top surface 94 and gasket bottom surface 96 present a friction coefficient, which depends on the material used to form the gasket and whether lubricant is applied to the gasket. Reducing friction at this gasket interface, for example by adding a lubricant or by coating the gasket in a low-friction material, leads to a reduction in the tensile stress created by the assembly process; but only for lower seat angles. The friction-reducing coating is preferably located between the gasket and the shell. As the seat angle increases a point is reached where the gasket begins to slide on the shell and the tensile stress increases sharply due to deformation of the insulator seat 28. If the friction coefficient is less than or equal to 0.15, then the insulator seat angle $\alpha_i$ is preferably from 35° to 45°. If the friction coefficient is greater than 0.15, then the insulator seat angle $\alpha_i$ can be up to 50°.

Figure 2A:
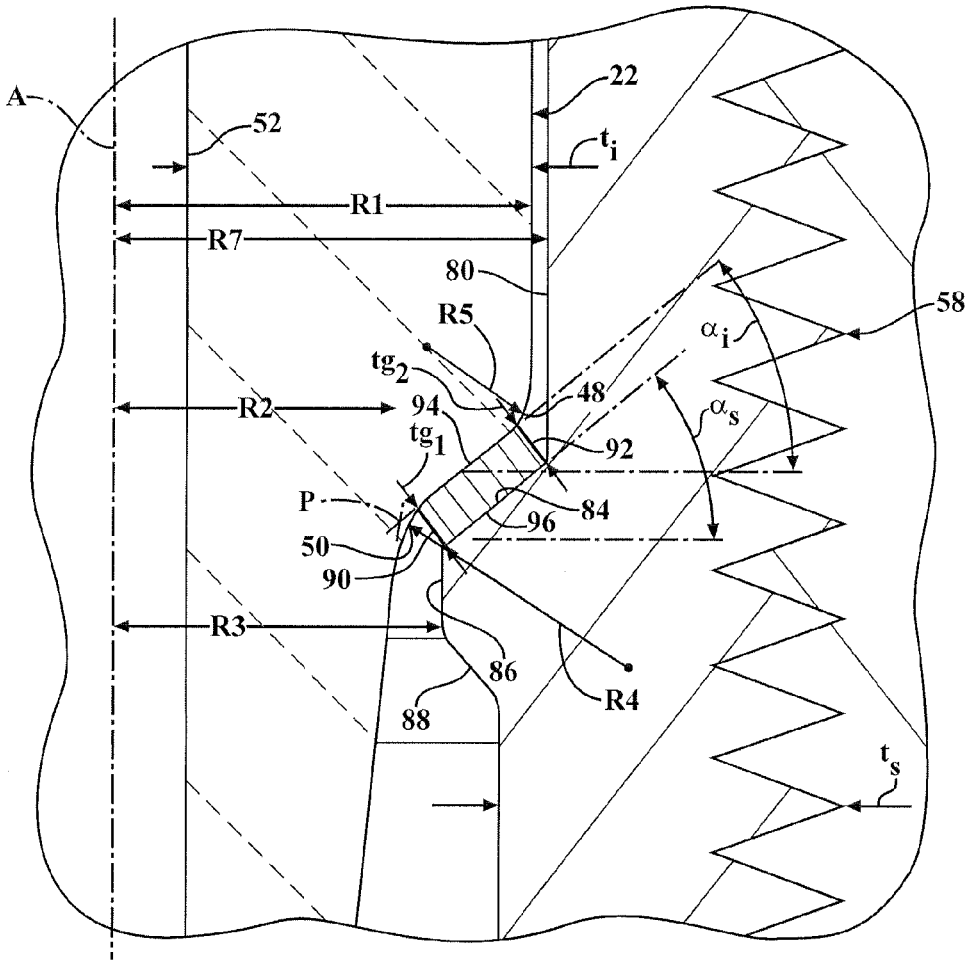
FIG. 2A is an enlarged view of a portion of FIG. 2.

The first gasket 60 presents an outer gasket thickness $t_{g1}$ extending from the gasket top surface 94 to the gasket bottom surface 96 at the gasket outer surface 92. The first gasket 60 also presents an inner gasket thickness $t_{g2}$ extending from the gasket top surface 94 to the gasket bottom surface 96 at the gasket inner surface 90. As shown in FIG. 2A, the outer gasket thickness $t_{g1}$ is greater than the inner gasket thickness $t_{g2}$. The inner gasket thickness $t_{g2}$ is preferably greater than or equal to 70% of the outer gasket thickness $t_{g1}$.

The ground electrode 64 is attached to the shell 58, as shown in FIG. 1, and extends from the shell lower end 74 to a ground electrode firing end 102. The ground electrode 64 extends parallel to the center axis A and then curves toward the center axis A. The ground electrode 64 presents a ground spark surface 98 facing parallel to and spaced from the center electrode firing end 100 such that the center electrode firing end 100 and the ground spark surface 98 present a spark gap therebetween.

Another aspect of the invention provides a method of manufacturing the spark plug 20 including an insulator 22 with the insulator seat angle $\alpha_i$ being from 35° to 50° and the insulator seat angle $\alpha_i$ being greater than or equal to a boundary value provided by the equation: $90° - a\cos[1-(R_1-R_2)\div(R_4+R_5)]$.

The method first comprises selecting a value for the insulator seat angle $\alpha_i$ ($\alpha_i$) between 35° to 50°. The method next includes obtaining values for $R_1$, $R_2$, $R_4$, and $R_5$. The values can be calculated using various different methods. The value of $R_4$ is preferably maximized while maintaining an acceptable value of $R_2$. Once the values of $R_1$, $R_2$, $R_4$, and $R_5$ are obtained, the method includes determining whether the selected insulator seat angle $\alpha_i$ is greater than or equal to the boundary value provided by the equation. If the selected insulator seat angle $\alpha_i$ is greater than or equal to the boundary value, then the method can include forming the insulator 22 with the selected insulator seat angle $\alpha_i$ and obtained values of $R_1$, $R_2$, $R_4$, and $R_5$.

If the selected insulator seat angle $\alpha_i$ is less than the boundary value, then the method includes adjusting at least one of the values of $R_1$, $R_2$, $R_4$, and $R_5$ so that the boundary value is greater than or equal to the selected insulator seat angle $\alpha_i$.

Alternatively, even if the boundary value is greater than or equal to the selected insulator seat angle $\alpha_i$, the method can include adjusting at least one of the values of $R_1$, $R_2$, $R_4$, and $R_5$ so that the boundary value is closer to the selected insulator seat angle $\alpha_i$. For example, the method could include increasing the selected value of $R_4$ and decreasing $R_2$ while maintaining the insulator seat angle $\alpha_i$ greater than or equal to the boundary value. The selected insulator seat angle $\alpha_i$ is preferably not greater than 300% of the boundary value, more preferably not greater than 200% of the boundary value, and yet more preferably not greater than 150% of the boundary value.

The method also includes obtaining a value for the third radius $R_3$, which is at the rib inner surface 86 of the shell 58 and extends from the center axis A to the shell inner surface 76. The method next includes determining whether the selected value for $R_3$ allows the selected insulator seat angle $\alpha_i$ to be greater than or equal to the boundary value. If the selected insulator seat angle $\alpha_i$ is less than the boundary value, then the method includes adjusting at least one of the values of $R_1$, $R_2$, $R_3$, $R_4$, and $R_5$.

Once the geometry of the insulator 22 and the shell 58 is determined, the method next includes compressing the first gasket 60 between the insulator seat 28 and the shell seat 84. The outer gasket thickness $t_{g1}$ is preferably greater than the inner gasket thickness $t_{g2}$ after the step of compressing the first gasket 60.

EXPERIMENT

Figure 4:
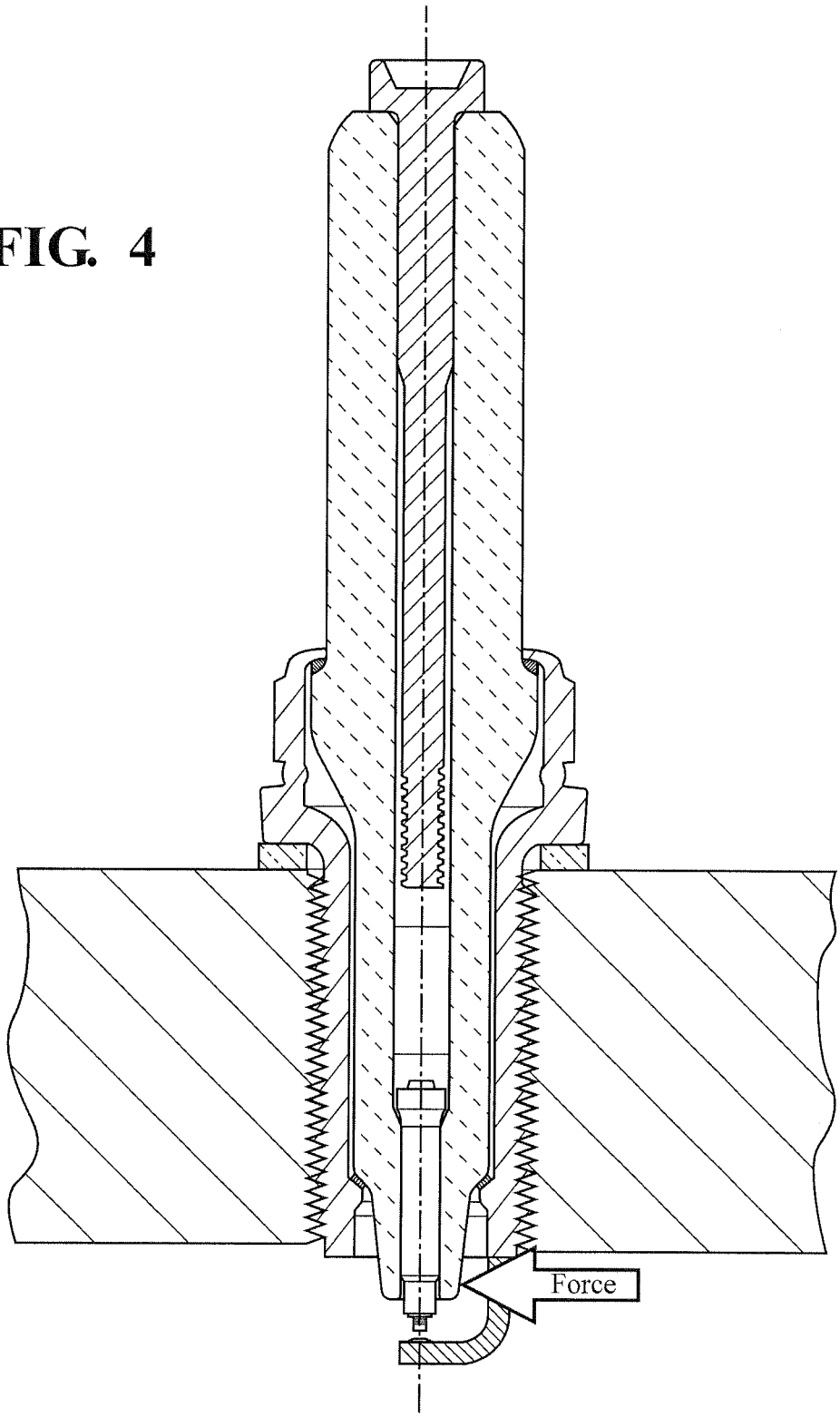
FIG. 4 is a cross-sectional view of a comparative spark plug.

Spark plugs of this invention are calculated by Finite Element Analysis (FEA) to have a lower tensile stress due to plug assembly which leads directly to reduced stress in bending. The geometry changes described here also lead to an additional reduction in stress due to bending loads, due to better distribution of load. An experiment was conducted to compare the bending strength during use of the inventive spark plug 20 having a shell outer diameter $D_3$ of 12 mm and an insulator seat angle $\alpha_i$ of 45° to a comparative spark plug having a shell outer diameter of 12 mm and insulator seat angle of 30°. The insulator 22 of the first inventive embodiment, shown in FIGS. 1 and 2; the insulator 22 of the second inventive embodiment, shown in FIG. 3; and the insulator of the comparative spark plug, shown in FIG. 4, were each tested. Table 1 provides $R_1$-$R_5$ for each of the spark plugs. Table 1 also provides the boundary value for each of the spark plugs, and the insulator seat angle $\alpha$s a percentage of the boundary value.

TABLE 1

| Dimension | First Embodiment (FIGS. 1 and 2) | Second Embodiment (FIG. 3) | Comparative Spark Plug (FIG. 4) |
|---|---|---|---|
| $\alpha$ | 45° | 45° | 30° |
| $R_1$ | 0.145"/ 3.683 mm | 0.145"/ 3.683 mm | 0.145"/ 3.683 mm |
| $R_2$ | 0.105"/ 2.667 mm | 0.095"/ 2.431 mm | 0.100"/ 2.540 mm |
| $R_3$ | 0.121"/ 3.073 mm | 0.121"/ 3.073 mm | 0.121"/ 3.073 mm |
| $R_4$ | 0.080"/ 2.032 mm | 0.120"/ 2.048 mm | 0.030"/ 0.762 mm |
| $R_5$ | 0.020"/ 0.508 mm | 0.020"/ 0.508 mm | 0.020"/ 0.508 mm |
| Boundary | 36.87 | 40.00 | 5.74 |
| $\alpha$ as % of Boundary | 122% | 112% | 523% |

Figure 5:
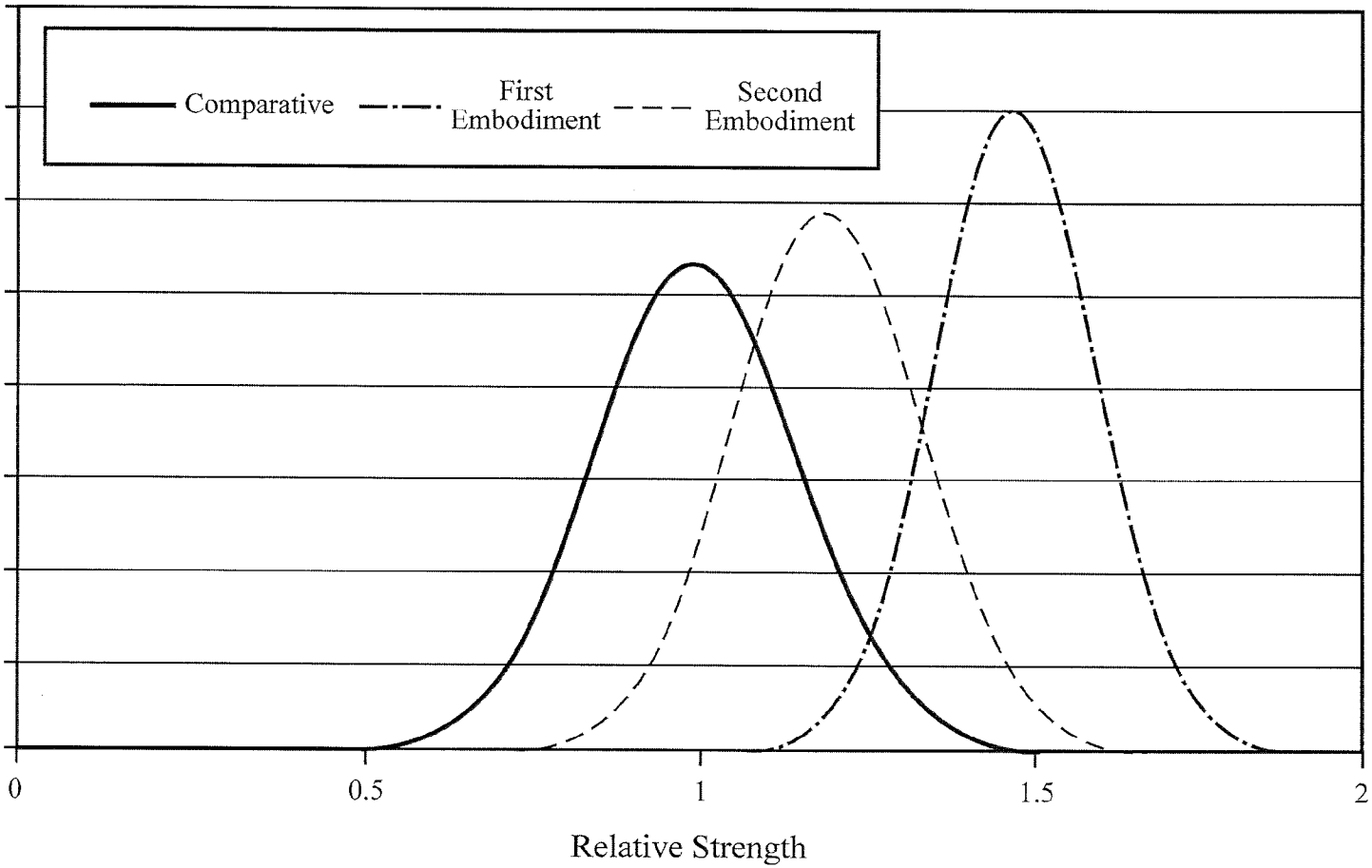
FIG. 5 is a graph illustrating the bending strength of the spark plugs of FIGS. 1, 3, and 4.

The FEA results indicate the average tensile stress during assembly of the inventive spark plug 20 according to the first embodiment and the second embodiment is less than the average tensile stress during assembly of the comparative spark plug and indicate an improvement in bending strength. Table 2 and FIG. 5 provides the bending strength test results, and illustrate the average bending strength of the inventive spark plug 20 according to the first embodiment and the second embodiment is greater than the average bending strength of the comparative spark plug.

TABLE 2

| | First Embodiment (FIGS. 1 and 2) | Second Embodiment (FIG. 3) | Comparative Spark Plug (FIG. 4) |
|---|---|---|---|
| Average bending strength | 901N | 728N | 609N |

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

ELEMENT LIST

| Element Symbol | Element Name |
|---|---|
| A | center axis |
| $D_1$ | insulator inner diameter |
| $D_2$ | insulator outer diameter |
| P | point |
| 20 | spark plug |
| 22 | insulator |
| 24 | insulator body region |
| 26 | insulator nose region |
| 28 | insulator seat |
| 30 | insulator outer surface |
| 32 | insulator inner surface |
| 34 | insulator upper end |
| 36 | insulator nose end |
| 38 | insulator terminal region |
| 40 | insulator transition region |
| 42 | insulator upper shoulder |
| 44 | insulator lower shoulder |
| 46 | electrode seat |
| 48 | first transition |
| 50 | second transition |
| 52 | center electrode |
| 54 | terminal |
| 56 | seal |
| 58 | shell |
| 60 | first gasket |
| 62 | second gasket |
| 64 | ground electrode |
| 66 | electrode terminal end |
| 68 | energy input end |
| 70 | energy output end |
| 72 | shell upper end |
| 74 | shell lower end |
| 76 | shell inner surface |
| 78 | shell outer surface |
| 80 | shell body region |
| 82 | rib |
| 84 | shell seat |
| 86 | rib inner surface |
| 88 | rib lower surface |
| 90 | gasket inner surface |
| 92 | gasket outer surface |
| 94 | gasket top surface |
| 96 | gasket bottom surface |
| 98 | ground spark surface |
| 100 | center electrode firing end |
| 102 | ground electrode firing end |
| $\alpha_i$ | insulator seat angle |
| $\alpha_s$ | shell seat angle |
| $R_1$ | first radius |
| $R_2$ | second radius |
| $R_3$ | third radius |
| $R_4$ | fourth radius |

-continued

| ELEMENT LIST | |
|---|---|
| Element Symbol | Element Name |
| $R_5$ | fifth radius |
| $R_6$ | sixth radius |
| $R_7$ | seventh radius |
| $t_{g1}$ | outer gasket thickness |
| $t_{g2}$ | inner gasket thickness |
| $t_i$ | insulator thickness |
| $t_s$ | shell thickness |

What is claimed is:

1. A spark plug (20), comprising:

an insulator (22) extending along a center axis (A) and presenting an insulator outer surface (30) extending from an insulator upper end (34) to an insulator nose end (36);

said insulator (22) including an insulator body region (24) extending between said insulator upper end (34) and said insulator nose end (36);

said insulator (22) presenting a first radius ($R_1$) at said insulator body region (24) extending from said center axis (A) to said insulator outer surface (30);

said insulator (22) including an insulator nose region (26) between said insulator body region (24) and said insulator nose end (36);

said insulator (22) presenting a sixth radius ($R_6$) at said insulator nose region (26) extending from said center axis (A) to said insulator outer surface (30), said sixth radius ($R_6$) being less than said first radius ($R_1$);

said insulator (22) including an insulator seat (28) disposed between said insulator body region (24) and said insulator nose region (26), said insulator seat (28) extending radially toward said center axis (A) at an insulator seat angle ($\alpha_i$);

said insulator (22) including a first transition (48) extending from said insulator body region (24) to said insulator seat (28), said first transition (48) being convex;

said insulator (22) presenting a fifth radius ($R_5$) at said first transition (48), said fifth radius ($R_5$) being a spherical radius at said first transition (48);

said insulator (22) presenting a second transition (50) extending from said insulator seat (28) to said insulator nose region (26), said second transition (50) being concave;

said insulator (22) presenting a second radius ($R_2$) extending from said center axis (A) to a point (P) at the intersection of said insulator outer surface (30) of said insulator seat (28) and said insulator outer surface (30) of said insulator nose region (26) adjacent said second transition (50);

said insulator (22) presenting a fourth radius ($R_4$) at said second transition (50), said fourth radius ($R_4$) being a spherical radius at said second transition (50);

said insulator seat angle ($\alpha_i$) being from 35° to 50°; and said insulator seat angle ($\alpha_i$) being greater than or equal to a boundary value provided by the equation: $90°-\text{acos}[1-(R_1-R_2)\div(R_4+R_5)]$.

2. The spark plug (20) of claim 1 wherein said insulator seat angle ($\alpha_i$) is not greater than 300% of the boundary value.

3. The spark plug (20) of claim 2 wherein said insulator seat angle ($\alpha_i$) is not greater than 200% of the boundary value.

4. The spark plug (20) of claim 3 wherein said insulator seat angle ($\alpha_i$) is not greater than 150% of the boundary value.

5. The spark plug (20) of claim 1 including a shell (58) presenting a shell inner surface (76) facing said insulator inner surface (32) and extending from a shell upper end (72) to a shell lower end (74);

said shell (58) including a shell body region (80) between said shell upper end (72) and said shell lower end (74);

said shell (58) presenting a seventh radius ($R_7$) at said shell body region (80) extending from said center axis (A) to said shell inner surface (76);

said shell (58) including a rib (82) extending radially toward said center axis (A) and disposed between said shell body region (80) and said shell lower end (74);

said rib (82) including a shell seat (84) facing said insulator seat (28) and extending from said shell body region (80) radially inwardly toward said center axis (A) at a shell seat angle ($\alpha_s$) to a rib inner surface (86); and said shell (58) presenting a third radius ($R_3$) at said rib inner surface (86) extending from said center axis (A) to said shell inner surface (76), said third radius ($R_3$) being less than said seventh radius ($R_7$).

6. The spark plug (20) of claim 5 wherein said shell seat angle ($\alpha_s$) is within +/−1° of said insulator seat angle ($\alpha_i$).

7. The spark plug (20) of claim 5 wherein said third radius ($R_3$) is 0.121 inches (3.073 mm).

8. The spark plug (20) of claim 5 including a first gasket (60) compressed between said insulator seat (28) and said shell seat (84);

said first gasket (60) having a gasket inner surface (90) facing toward said insulator (22) and a gasket outer surface (92) facing toward said shell (58), said gasket inner surface (90) and said gasket outer surface (92) each extending from a gasket top surface (94) to a gasket bottom surface (96);

said first gasket (60) presenting an outer gasket thickness ($t_{g1}$) extending from said gasket top surface (94) to said gasket bottom surface (96) at said gasket outer surface (92) and an inner gasket thickness ($t_{g2}$) extending from said gasket top surface (94) to said gasket bottom surface (96) at said gasket inner surface (90); and said outer gasket thickness ($t_{g1}$) being greater than said inner gasket thickness ($t_{g2}$).

9. The spark plug (20) of claim 8 wherein said inner gasket thickness ($t_{g2}$) is greater than or equal to 70% of said outer gasket thickness ($t_{g1}$).

10. The spark plug (20) of claim 8 wherein said gasket top surface (94) and said gasket bottom surface (96) have a friction coefficient less than or equal to 0.15 and said insulator seat angle ($\alpha_i$) is from 35° to 45°.

11. The spark plug (20) of claim 1 wherein said insulator seat angle ($\alpha_i$) is 45°±/−2°.

12. The spark plug (20) of claim 1 wherein said insulator seat angle ($\alpha_i$) is 45°, $R_1$ is 0.145 inches (3.683 mm), $R_2$ is 0.105 inches (2.667 mm), $R_4$ is 0.080 inches (2.032 mm), $R_5$ is 0.020 inches (0.508 mm), and said insulator seat angle ($\alpha_i$) is equal to 122% of the boundary value.

13. The spark plug (20) of claim 1 wherein said insulator seat angle ($\alpha_i$) is 45°, $R_1$ is 0.145 inches (3.683 mm), $R_2$ is 0.095 inches (2.431 mm), $R_4$ is 0.120 inches (2.048 mm), $R_5$ is 0.020 inches (0.508 mm), and said insulator seat angle ($\alpha_i$) is equal to 112% of the boundary value.

14. The spark plug (20) of claim 1 wherein said insulator (22) includes an insulator inner surface (32) facing toward said center axis (A), said insulator inner surface (32) and said insulator outer surface (30) presenting an insulator thickness ($t_i$) therebetween;

said insulator inner surface (32) extending annularly around said center axis (A) and presenting a bore along said center axis (A);

said insulator inner surface presenting (32) an insulator inner diameter ($D_1$) surrounding said bore and said insulator outer surface (30) presenting an insulator outer diameter ($D_2$), wherein the ratio of said insulator inner diameter ($D_1$) to said insulator outer diameter ($D_1$) along said insulator body region (24) adjacent said insulator seat (28) is from 0.12 to 0.45;

said insulator thickness ($t_i$) along said insulator nose region (26) being less than said insulator thickness ($t_i$) along said insulator body region (24) and said insulator thickness ($t_i$) decreasing along said insulator nose region (26) toward said insulator nose end (36); and said insulator thickness ($t_i$) along said insulator seat (28) decreasing from said insulator body region (24) to said insulator nose region (26).

15. The spark plug (20) of claim 1 wherein said insulator (22) includes an insulator inner surface (32) extending from said insulator upper end (34) to said insulator nose end (36);

said insulator inner surface (32) and said insulator outer surface (30) presenting an insulator thickness ($t_i$) therebetween;

said insulator inner surface (32) extending annularly around said center axis (A) and presenting a bore extending longitudinally along said center axis (A);

said insulator (22) including an insulator terminal region (38) extending from said insulator upper end (34) toward said insulator nose end (36);

said insulator thickness ($t_i$) along said insulator terminal region (38) being constant;

said insulator (22) including an insulator transition region (40) between said insulator terminal region (38) and said insulator nose end (36);

said insulator thickness ($t_i$) along a portion of said insulator transition region (40) being greater than said insulator thickness ($t_i$) along said insulator terminal region (38);

said insulator thickness ($t_i$) along a portion of said insulator transition region (40) being less than said insulator thickness ($t_i$) along said insulator terminal region (38);

said insulator thickness ($t_i$) along a portion of said insulator transition region (40) decreasing toward said insulator nose end (36);

said insulator (22) including an insulator upper shoulder (42) extending from said insulator terminal region (38) to said insulator transition region (40);

said insulator thickness ($t_i$) along said insulator upper shoulder (42) increasing from said insulator terminal region (38) to said insulator transition region (40);

said insulator (22) including said insulator body region (24) between said insulator transition region (40) and said insulator nose end (36);

said insulator (22) including an insulator lower shoulder (44) extending from said insulator transition region (40) to said insulator body region (24);

said insulator thickness ($t_i$) along said insulator lower shoulder (44) decreasing from said insulator transition region (40) to said insulator body region (24);

said insulator thickness ($t_i$) along said insulator body region (24) being less than said insulator thickness ($t_i$) along said insulator terminal region (38) and less than said insulator thickness ($t_i$) along said insulator transition region (40);

said insulator inner surface (32) presenting an insulator inner diameter ($D_1$) surrounding said bore and said insulator outer surface (30) presenting an insulator outer diameter ($D_2$), wherein the ratio of said insulator inner diameter ($D_1$) to said insulator outer diameter ($D_1$) along said insulator body region (24) adjacent said insulator seat (28) is from 0.12 to 0.45;

said insulator thickness ($t_i$) along a portion of said insulator body region (24) being constant;

said insulator inner surface (32) along said insulator body region (24) presenting an electrode seat (46);

said insulator thickness ($t_i$) along a portion of said insulator body region (24) increasing toward said center axis (A) and toward said insulator nose end (36) to present said electrode seat (46);

said insulator thickness ($t_i$) being constant from said insulator transition region (40) to said electrode seat (46);

said insulator (22) including said insulator nose region (26) disposed between said insulator body region (24) and said insulator nose end (36);

said insulator nose region (26) tapering toward said insulator nose end (36);

said insulator thickness ($t_i$) along said insulator nose region (26) being less than said insulator thickness ($t_i$) along said insulator body region (24) and said insulator thickness ($t_i$) decreasing toward said insulator nose end (36);

said insulator seat angle ($\alpha_i$) being relative to a plane extending perpendicular to said center axis (A) and intersecting said insulator seat (28);

said insulator thickness ($t_i$) along said insulator seat (28) decreasing from said insulator body region (24) to said insulator nose region (26);

said insulator seat angle ($\alpha_i$) being not greater than 200% of the boundary value;

said first radius ($R_1$) presented by said insulator (22) being constant from said insulator lower shoulder (44) to said second transition (50);

said insulator (22) formed of an electrically insulating material having a dielectric strength of 14 to 30 kV/mm and a relative permittivity of 2 to 12 and a coefficient of thermal expansion (CTE) between $2\times10^{-6}$/° C. and $18\times10^{-6}$/° C.;

said electrically insulating material including alumina;

a center electrode (52) received in said bore of said insulator (22) and extending longitudinally along said center axis (A) from an electrode terminal end (66) past said insulator nose end (36) to a center electrode firing end (100);

said center electrode (52) including a head at said electrode terminal end (66) resting on said electrode seat (46) of said insulator (22);

a ground electrode (64) extending from said shell lower end (74) parallel to said center axis (A) and curving toward said center axis (A) to a ground electrode firing end (102);

said ground electrode (64) presenting a ground spark surface (98) facing parallel to and spaced from said center electrode firing end (100);

said center electrode firing end (100) and said ground spark surface (98) presenting a spark gap therebetween;

a terminal (54) received in said bore of said insulator (22) and extending longitudinally along said center axis (A) from an energy input end (68) to an energy output end (70) spaced from electrode terminal end (66);

a seal (56) contained in said bore and extending continuously between said energy output end (70) of said terminal (54) and said electrode terminal end (66), said seal (56) being resistive or non-resistive;

a shell (58) formed of a steel material disposed annularly around said insulator (22) and extending longitudinally from a shell upper end (72) along said insulator transition region (40) and said insulator body region (24) to a shell lower end (74);

said shell (58) presenting a shell inner surface (76) facing said insulator inner surface (32) and a shell outer surface (78) facing opposite said shell inner surface (76), said shell inner surface (76) and said shell outer surface (78) each extending from said shell upper end (72) to said shell lower end (74), said shell inner surface (76) and said shell outer surface (78) presenting a shell thickness ($t_s$) therebetween;

said shell (58) including a shell body region (80) extending along said center axis (A) between said shell upper end (72) and said shell lower end (74);

said shell (58) presenting a seventh radius ($R_7$) at said shell body region (80) and extending from said center axis (A) to said shell inner surface (76);

said shell upper end (72) being disposed along said insulator upper shoulder (42) and said shell lower end (74) being disposed along said insulator nose region (26) such that said insulator nose end (36) is disposed outwardly of said shell lower end (74);

said shell (58) including a rib (82) extending radially toward said center axis (A) between said shell body region (80) and said shell lower end (74);

said rib (82) presenting a shell seat (84) facing said insulator seat (28) and extending from said shell body region (80) radially inwardly toward said center axis (A) at a shell seat angle ($\alpha_s$) to a rib inner surface (86), said rib inner surface (86) being disposed at the innermost point of said shell inner surface (76);

said shell (58) presenting a third radius ($R_3$) at said rib inner surface (86) extending from said center axis (A) to said shell inner surface (76), said third radius ($R_3$) being less than said seventh radius ($R_7$);

said shell thickness ($t_s$) being constant along said insulator body region (24) and increasing adjacent said insulator seat (28) of said insulator (22) to present said rib (82);

said shell seat (84) facing and parallel to said insulator seat (28);

said shell seat angle ($\alpha_s$) being relative to a plane extending perpendicular to said center axis (A) and intersecting said shell seat (84);

said shell seat angle ($\alpha_s$) being equal to said insulator seat angle ($\alpha$) or within +/−1° of said insulator seat angle ($\alpha_i$);

said rib (82) including a rib lower surface (88) facing toward said shell lower end (74) and extending radially outwardly from said rib inner surface (86) at an angle toward said shell lower end (74);

said shell thickness ($t_s$) increasing gradually along said shell seat (84) to said rib inner surface (86) and being constant along said rib inner surface (86) and decreasing along said rib lower surface (88) toward said shell lower end (74);

said shell outer surface 78 including threads along at least a portion of said shell body region 80 and adjacent said rib 82;

a first gasket (60) compressed between said insulator seat (28) and said shell seat (84), said first gasket (60) having an gasket inner surface (90) facing generally toward said insulator (22) and a gasket outer surface (92) facing generally toward said shell (58) and extending from a gasket top surface (94) to a gasket bottom surface (96);

said gasket top surface (94) and said gasket bottom surface (96) having a friction coefficient;

said first gasket (60) presenting an outer gasket thickness ($t_{g1}$) extending from said gasket top surface (94) to said gasket bottom surface (96) at said gasket outer surface (92) and an inner gasket thickness ($t_{g2}$) extending from said gasket top surface (94) to said gasket bottom surface (96) at said gasket inner surface (90);

said outer gasket thickness ($t_{g1}$) being greater than said inner gasket thickness ($t_{g2}$);

said inner gasket thickness ($t_{g2}$) being greater than or equal to 70% of said outer gasket thickness ($t_{g1}$); and a second gasket (62) compressed between said insulator upper shoulder (42) and said shell upper end (72).

16. A method of manufacturing a spark plug (20), wherein the spark plug (20) comprises:

an insulator (22) extending along a center axis (A) and presenting an insulator outer surface (30) extending from an insulator upper end (34) to an insulator nose end (36);

the insulator (22) including an insulator body region (24) extending between the insulator upper end (34) and the insulator nose end (36);

the insulator (22) presenting a first radius ($R_1$) at the insulator body region (24) and extending from the center axis (A) to the insulator outer surface (30);

the insulator (22) including an insulator nose region (26) between the insulator body region (24) and the insulator nose end (36);

the insulator (22) presenting a sixth radius ($R_6$) at the insulator nose region (26) and extending from the center axis (A) to the insulator outer surface (30), the sixth radius ($R_6$) being less than the first radius ($R_1$);

the insulator (22) including an insulator seat (28) disposed between the insulator body region (24) and the insulator nose region (26), the insulator seat (28) extending radially toward the center axis (A) at an insulator seat angle ($\alpha_i$);

the insulator (22) including a first transition (48) extending from the insulator body region (24) to the insulator seat (28), the first transition (48) being convex;

the insulator (22) presenting a fifth radius ($R_5$) at the first transition (48), the fifth radius ($R_5$) being a spherical radius at the first transition (48);

the insulator (22) presenting a second transition (50) extending from the insulator seat (28) to the insulator nose region (26), the second transition (50) being concave;

the insulator (22) presenting a second radius ($R_2$) extending from the center axis (A) to a point (P) at the intersection of the insulator outer surface (30) of the insulator seat (28) and the insulator outer surface (30) of the insulator nose region (26) adjacent the second transition (50);

the insulator (22) presenting a fourth radius ($R_4$) at the second transition (50), the fourth radius ($R_4$) being a spherical radius at the second transition (50);

the insulator seat angle ($\alpha_i$) being from 35° to 50°;

the insulator seat angle ($\alpha_i$) being greater than or equal to a boundary value provided by the equation: $90° - a\cos[1-(R_1-R_2)\div(R_1+R_5)]$; and comprising the steps of:

selecting a value for the insulator seat angle ($\alpha_i$) between 35° to 50°;

obtaining values for $R_1$, $R_2$, $R_4$, and $R_5$;

determining whether the selected insulator seat angle ($\alpha_i$) is greater than or equal to a boundary value provided by the equation: $90° - a\cos[1-(R_1-R_2)\div(R_4+R_5)]$.

17. The method of claim 16 including adjusting at least one of the values of $R_1$, $R_2$, $R_4$, and $R_5$ if the selected insulator seat angle ($\alpha_i$) is less than the boundary value.

18. The method of claim 16 including forming the insulator (22) with the selected insulator seat angle ($\alpha_i$) and the obtained values of $R_1$, $R_2$, $R_4$, and $R_5$ if the selected insulator seat angle ($\alpha_i$) is greater than or equal to the boundary value.

19. The method of claim 16 including increasing the selected value of $R_4$ while maintaining the insulator seat angle ($\alpha_i$) greater than or equal to the boundary value.

20. The method of claim 16 wherein the spark plug (20) includes a shell (58) presenting a shell inner surface (76) facing the insulator inner surface (32) and extending from a shell upper end (72) to a shell lower end (74);

the shell (58) includes a shell body region (80) extending along the center axis (A) between the shell upper end (72) and the shell lower end (74);

the shell (58) presents a seventh radius ($R_7$) extending from the center axis (A) to the shell inner surface (76) along the shell body region (80);

the shell (58) presents a rib (82) extending radially toward the center axis (A) and disposed between the shell body region (80) and the shell lower end (74), the rib (82) including a rib inner surface (86);

the shell (58) presents a third radius ($R_3$) extending from the center axis (A) to the shell inner surface (76) along the rib inner surface (86), the third radius ($R_3$) being less than the seventh radius ($R_7$);

the shell (58) includes a shell seat (84) facing the insulator seat (28) and extending from the shell body region (80) radially inwardly toward the center axis (A) at a shell seat angle ($\alpha_s$) to the rib inner surface (86); and including the steps of:

obtaining a value for $R_3$;

determining whether the selected value for $R_3$ allows the selected insulator seat angle ($\alpha_i$) to be greater than or equal to the boundary value;

adjusting at least one of the values of $R_1$, $R_2$, $R_3$, $R_4$, and $R_5$ if the selected insulator seat angle ($\alpha_i$) is less than the boundary value; and compressing a first gasket (60) between the insulator seat (28) and the shell seat (84).

21. The method of claim 20 wherein the first gasket (60) has a gasket inner surface (90) facing toward the insulator (22) and a gasket outer surface (92) facing toward the shell (58);

the gasket inner surface (90) and the gasket outer surface (92) each extend from a gasket top surface (94) to a gasket bottom surface (96);

the first gasket (60) presents an outer gasket thickness ($t_{g1}$) extending from the gasket top surface (94) to the gasket bottom surface (96) at the gasket outer surface (92) and an inner gasket thickness ($t_{g2}$) extending from the gasket top surface (94) to the gasket bottom surface (96) at the gasket inner surface (90); and the outer gasket thickness ($t_{g1}$) is greater than the inner gasket thickness ($t_{g2}$) after the step of compressing the first gasket (60).

* * * * *

UNITED STATES PATENT AND TRADEMARK OFFICE

CERTIFICATE OF CORRECTION

PATENT NO. : 8,643,263 B2
APPLICATION NO. : 13/709237
DATED : February 4, 2014
INVENTOR(S) : Burrows It is certified that error appears in the above-identified patent and that said Letters Patent is hereby corrected as shown below:

In the Specification

| Column | Line | |
|---|---|---|
| 4 | 53 | "between 2×10-6PC" should read "between $2 \times 10^{-6}$/°C" |

Signed and Sealed this
Twentieth Day of May, 2014

Michelle K. Lee

Michelle K. Lee
*Deputy Director of the United States Patent and Trademark Office*